United States Patent [19]

Genevray

[11] Patent Number: 4,951,454

[45] Date of Patent: Aug. 28, 1990

[54] DEVICE FOR STOPPING THE SUPPLY TO A SPINNING FRAME DRAWING SYSTEM IN CASE OF ABSENCE OF YARN AT THE OUTLET

[75] Inventor: C. Henri Genevray, Guebwiller, France

[73] Assignee: N. Schlumberger & Cie, France

[21] Appl. No.: 378,385

[22] Filed: Jul. 11, 1989

[30] Foreign Application Priority Data

Jul. 12, 1988 [FR] France ..... 88 09462

[51] Int. Cl.[5] ..... D01H 13/16

[52] U.S. Cl. ..... 57/84; 57/80

[58] Field of Search ..... 57/78–87

[56] References Cited

U.S. PATENT DOCUMENTS 1,374,417 4/1921 Arragg ..... 57/84

2,019,673 11/1935 Gow ..... 57/84

2,421,555 6/1947 Fraser ..... 57/84

2,599,256 6/1952 Hartley et al. ..... 57/84

3,019,587 2/1962 Weiss ..... 57/84

4,365,465 12/1982 Muller et al. ..... 57/84

*Primary Examiner*—John Petrakes

*Attorney, Agent, or Firm*—Levisohn, Lerner & Berger

[57] ABSTRACT

A device, to be incorporated in a spinning frame and including supply rollers for the input of a sliver, a sliver control and drawing station for transforming said sliver into a yarn, and a yarn winding outlet station, comprises on the one hand, between the control and drawing station and the yarn winding outlet station, detector means for detecting the presence of the yarn, and, on the other hand, sensitive means responsive to said detector means for stopping the sliver feed by the supply rollers in case of absence of yarn as detected at the outlet.

11 Claims, 2 Drawing Sheets

DEVICE FOR STOPPING THE SUPPLY TO A SPINNING FRAME DRAWING SYSTEM IN CASE OF ABSENCE OF YARN AT THE OUTLET

FIELD OF THE INVENTION

The present invention relates to drawing textile systems of spinning frames, and it relates more precisely to a device allowing stopping the sliver feed when, at the outlet of the spinning frame, the yarn is not present, which can result either from a yarn breakage at the outlet or from a winding of the yarn or of the sliver on a roller.

In spinning frames, the sliver is fed or delivered by supply rollers, it passes through a control and drawing station transforming it into a yarn, then the yarn is wound at the outlet. When there is no yarn on the outlet drawing rollers, this means that a yarn or sliver breakage has occured upstream, and the sliver fibers are then swallowed by a suction system or they flutter about the machine; it is also possible that the yarn or the sliver gets wound on a roller upstream of the drawing rollers.

Such situations can result in very severe consequences for the equipment, the yield and the yarn obtained. Indeed, when all the sliver fibers are swallowed by the suction device, there is no more yarn at the outlet of this station, thereby obviously reducing the overall output of the machine. On the other hand, when the fibers flutter about the machine, some of them are caught by the neighbouring yarns, thereby deteriorating the quality of the product obtained, while other fibers deposit on the machine or on vital members, compelling the personnel to be constantly vigilant, and this obligation also reduces the machine yield. Finally, when the yarn or the sliver gets wound about a roller, the material can reach such a thickness and/or such a hardness that this roller can escape from its bearings or can be severely deteriorated by deformation of rupture, obviously causing considerable damages to the machine.

BACKGROUND OF THE INVENTION

A system is known by the German patent application Ser. No. 3 042 946 in which one of the supply rollers is moved away from the other supply roller simply by a core electrical device controlled by a yarn detector, the first roller moving only according a rectilinear path to disengage or engage the second roller.

A system is also known from German Patent of Addition No. 515.088 in which the yarn break automatically causes the tilting of a lever which, in turn, controls a complex counterweight rodding system.

From Belgian Patent No. 769.257 is also known a system in which a yarn break causes the tilting of a thread-guide which, in turn, via an excentric, causes the longitudinal sliding of a double arm carrying one of the supply rollers of two pairs of rollers in order to retract it from the other roller of each pair.

These various known systems are fragile, complex and costly.

OBJECTS AND SUMMARY OF THE INVENTION

The object of the invention is to remedy these drawbacks by providing a simple, reliable and little costly device which allows stopping the feeding of a spinning frame drawing system when there is no yarn at the outlet.

To this effect, the device according to the invention, adapted for being used in a spinning frame including supply drive rollers in pressure contact for the input of the sliver, a sliver control and drawing station for transforming said sliver into a yarn, a yarn winding outlet station, means for detecting the presence of a yarn, between the control and drawing station and the yarn winding outlet station, means responsive to said detector means in order to stop the sliver supply by the supply rollers when an absence of yarn is detected at the outlet, a first one of the supply rollers being mounted on a disengageable movable assembly in order to disengage the supply rollers from one another under the action of said responsive means so as to stop the sliver supply, is characterized in that the movable assembly is biased towards its engaged active position and towards its disengaged inactive position for stopping the sliver supply by a resilient mechanism of the neutral point overriding type which, for the engaged active position, applies under pressure said first supply roller against the second supply roller.

For example, the detector means may an optical detector, e.g. a photoelectric cell, or a mechanical detector, e.g. a yarn-breakage detector.

According to a particular embodiment, the input supply rollers are a drive roller and an idle roller in pressure contact with the drive roller, the idle roller being mounted on the disengageable movable assembly in order to move apart the supply rollers from one another under the action of said sensitive means in order to stop the sliver feed.

The movable assembly can carry a disengagement element adapted for cooperating with a disengagement control member and with at least one holding member holding said disengagement element normally out of cooperation with the disengagement control member and arranged for retracting when an absence of a yarn at the outlet is detected so as to cause the disengagement element to cooperate with the disengagement control member.

For example, the disengagement element is an arm having a catch and the disengagement control member is a rotating shaft carrying at least one tooth for engaging said catch in the disengagement direction of the movable assembly.

The holding member may be at least one rod retractable under the control of the detector means.

The disengagement element is caused to cooperate with the disengagement control member or with the holding member by a return action, for example by gravity or by a spring.

Advantageously, the disengagement control member is arranged so as to act on the disengagement element, also in the disengaged position of the movable assembly, in order to retract it from the return path of the holding member towards its holding active position.

BRIEF DESCRIPTION OF DRAWINGS

The invention will be better understood from the reading of the following description and with reference to the accompanying drawings which are part of the description and in which.

DETAILED DESCRIPTION OF THE INVENTION

Figure 1:
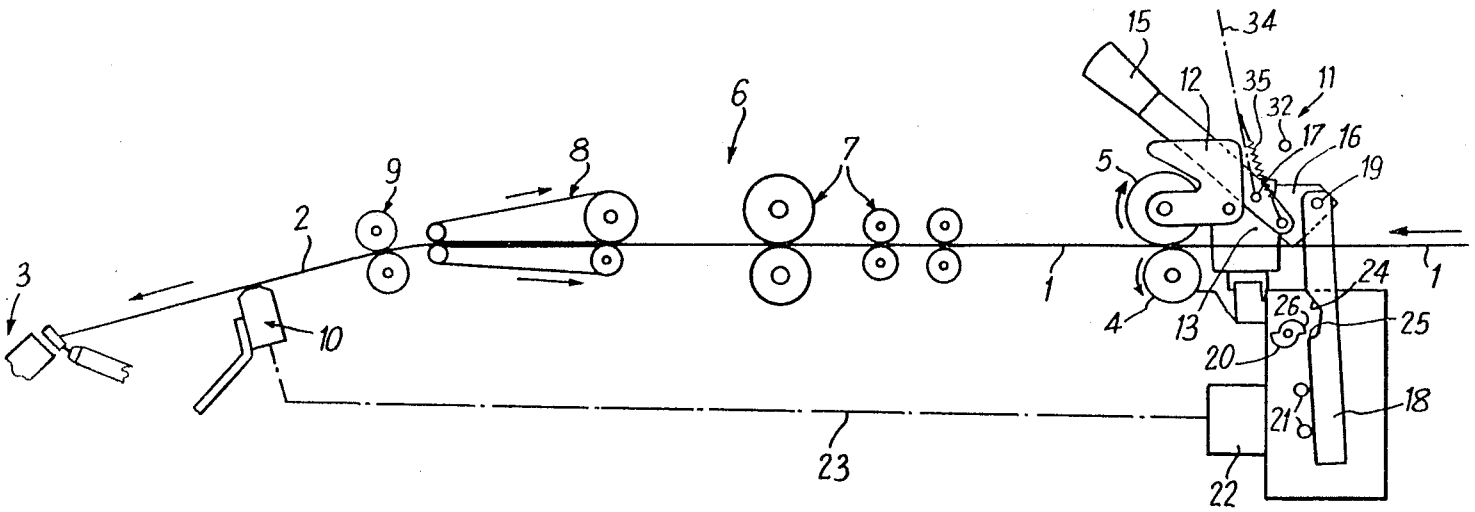
FIG. 1 is a schematic longitudinal sectional view of a spinning frame drawing system equipped with a device according to an embodiment of the invention.

With reference to FIG. 1, there is shown a spinning frame drawing system with which a sliver 1 is drawn so as to form at the outlet a yarn 2 which is recovered in a winding outlet station 3. The drawing system includes an inlet station comprising two supply rollers 4,5, and a station 6 for controlling and drawing the sliver 1, including for example successively pairs of rollers 7, a pair of sleeves 8 and a pair of drawing rollers 9.

In order to stop the above sliver supply when an absence of yarn 2 occurs downstream of the drawing rollers 9, there is provided between the drawing rollers 9 and the outlet station 3 detector means 10 for detecting the presence or the absence of the yarn, and sensitive means responsive to the detector means 10 for controlling the sliver feed stoppage when the detector means 10 indicates an absence of yarn.

The detector means 10 may be of any appropriate type, for example optical, e.g. of the photoelectric cell type, or mechanical, e.g. of the yarn-breakage detector type.

The device according to the invention is arranged for controlling the sliver feed stoppage only for that drawing system at the outlet of which an absence of yarn has been detected, the other spinning frame drawing systems remaining in operation. In such a spinning frame, all the supply rollers 4 are continuously driven while the associated roller 5 is idle and in pressure contact with its drive roller 4 for providing the driving of the sliver by friction.

The idle supply roller 5 is mounted, on either side, on an armature 12 with respect to which it can rotate about a transverse axis. Armature 12 can be part of a movable composite assembly 11 and it is carried by a fixed support 13 with respect to which it can tilt in a limited manner about an articulation 14 the transverse axis of which is situated slightly upstream of the axis of roller 5 and substantially at the same height. Armature 12 is resiliently urged towards its disengaged position (FIG. 3) for which the idle roller 5 is disengaged from the drive roller 4 by a spring 30, for example a torsion spring, acting between armature 12 and support 13. Spring 30 is designed so as to apply a torque which is just sufficient for driving apart roller 5 from roller 4 when the assembly made of armature 12 and roller 5 is subjected only to its own weight.

Figure 2:
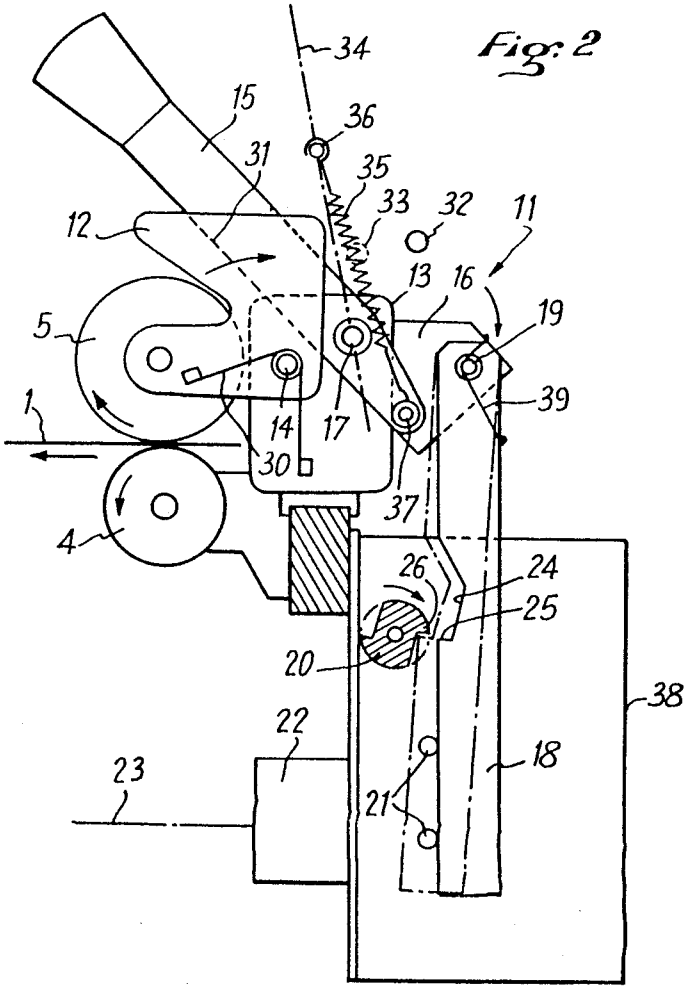
FIG. 2 shows an enlarged longitudinal sectional view of the sliver feed upstream station of the drawing system of FIG. 1, the supply rollers being in the active engaged position for feeding the sliver.

Armature 12 is brought and held in its active engaged position of FIG. 2 by a lever 15 cooperating with armature 12 in a unilateral manner by coming to bear for example on an abutment surface 31 of the armature. Lever 15 can tilt in a limited manner about a transverse articulation 17 which is carried by support 13 and the axis of which is situated slightly above and upstream of the axis of articulation 14. Lever 15 is rigidly connected to a plate 16, so that the assembly formed by lever 15 and plate 16 can swing between the two extreme positions shown in FIGS. 2 and 3, viz. respectively an active engaged position in which lever 15 is bearing on surface 31 of armature 12 in order to apply roller 5 against roller 4, this extreme position of lever 15 being defined by the abutment provided by roller 5 bearing on roller 4, and a disengaged inactive position in which lever 15 is bearing on an fixed abutment shown schematically at 32. In the disengaged position of lever 15 of FIG. 3, armature 12 carrying roller 5 is free and spring 30 causes the armature 12 to tilt about articulation 14 over an angle which is defined by a fixed abutment 33 and which is sufficient for separating roller 5 from roller 4. The assembly formed by lever 15 and plate 16 is subjected to the bilateral action of a mechanism of the overriding type resiliently urging this assembly, and in particular lever 15, on either side of a medium neutral angular position shown by the chain-dot line 34 of FIGS. 2 and 3. This neutral point overriding mechanism, shown schematically by a traction spring 35 anchored at an end to a fixed point 36 of the medium line 34 and at the other end to a point 37 of plate 16 applies a torque which is sufficient for largely overcoming the return torque biasing towards the disengaged position, exerted by spring 30 on armature 12. Usually, point 37 is selected so that it moves from one side to the other of the medium line 34 during the tilting of lever 15 between its two extreme positions.

Thus, for the engaged active position shown in FIG. 2, the idle roller 5 is applied under pressure against roller 4 due to the fact that the torque applied on armature 12 by lever 15 under the action of spring 35 is greater than the resisting torque applied by spring 30.

The tilting control of lever 15 and plate 16 about the fixed articulation 17 is carried out by hand in the engagement direction, that is for bringing roller 5 to bear under pressure against roller 4, and in an automatic manner in the disengaged direction, that is for moving apart roller 5 with respect to roller 4, when there is an absence of yarn at the outlet as indicated by detector 10.

Figure 3:
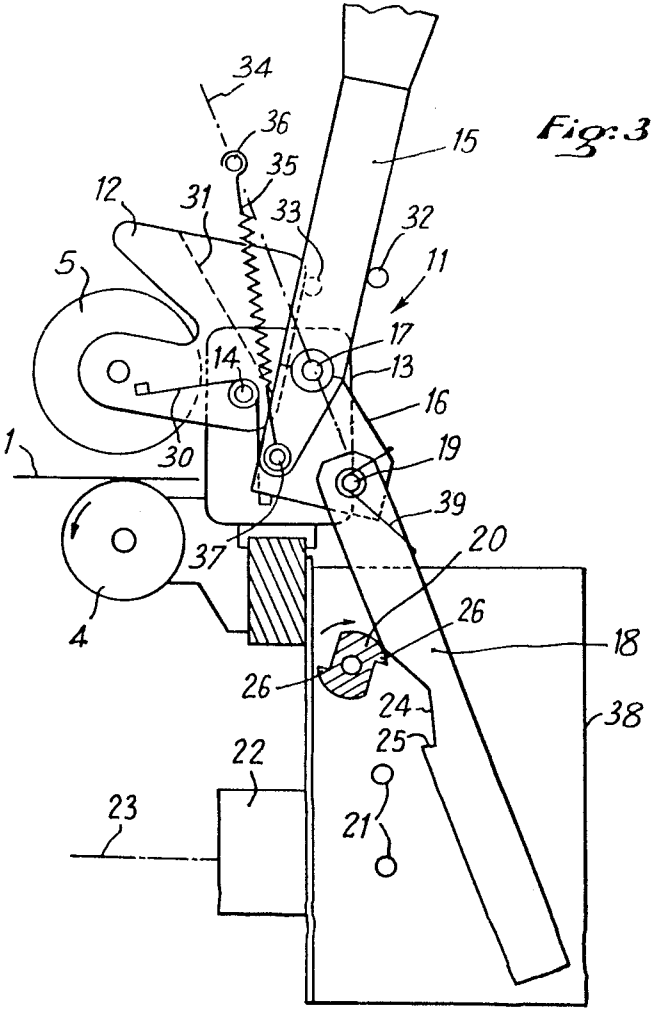
FIG. 3 is a view similar to FIG. 2 for the disengaged inactive position of the supply rollers, this position resulting from the detection of the absence of a yarn at the outlet of the system.

For that, in the shown embodiment, the movable assembly 11 includes an arm 18 which is articulated at its upper end on plate 16 about an articulation 19 having a transverse axis, and this arm 18 cooperates with holding and actuating means which is response to the detection carried out by detector 10 leaves lever 15 and roller 5 in the engaged active position of FIG. 2 or on the contrary causes the disengagement towards the position of FIG. 3.

The lower portion of the disengagement element formed by arm 18 extends into a casing 38 which includes on the one hand a disengagement control member 20 and on the other hand at least one holding member 21 maintaining normally arm 18 out of cooperation with member 20 as long as an absence of yarn has not been detected at the outlet. The disengagement control member 20 comprises for example a shaft extending over the whole length of the spinning frame, while permanently rotating, and carrying at least one tooth 26 adapted for cooperating with a catch 25 formed in the arm 18 at one end of a notch 24 thereof.

The holding member 21 is for example formed by two transverse rods which can be retracted under the control of an appropriate device 22 controlled by detector 10, as shown by the chain-dot line of action 23.

Arm 18 is permanently biased towards shaft 20 and rods 21 either by gravity or, as shown, for example by a torsion return spring 39 mounted on articulation 19 and acting between plate 16 and arm 18.

The geometry of arm 18, of shaft 20 and of rods 21 is designed so that, when rods 21 are in the holding position (FIG. 2), the catch 25 of arm 18 bearing against rods 21 is situated adjacent shaft 20 but out of action of teeth 26 and that, when rods 21 are retracted by device 22 due to the detection of an absence of yarn at the output, arm 18, under the action of return spring 39, comes to bear against shaft 20, as shown in chain-dot lines in FIG. 2. When arm 18 cooperates with shaft 20, the continuous rotation of the latter brings one of the teeth 26 to cooperate with catch 25, thereby drawing arm 28 downwardly and causing the tilting of plate 16 in conjunction with lever 15 about articulation 17 against the action of spring 35. While tooth 26 is still in mesh with catch 25, lever 15 passes over the neutral medium position 34 and, from that position, spring 35 causes the complete tilting of lever 15 and of plate 16 towards the extreme disengaged inactive position of FIG. 3 in which lever 15 is bearing on abutment 32. Once the medium position 34 has been passed, catch 25 of lever 18 leaves tooth 26, as shown in FIG. 3. During the subsequent continuous rotation of shaft 20, the latter still cooperates with arm 18, above catch 24, thereby moving arm against the action of spring 39 sufficiently away so that the rods 21 can come back to their active holding position, which can be achieved for example by a delay-time member incorporated into device 22.

For the disengaged position of FIG. 3, roller 5 is out of cooperation with drive roller 4, thereby interrupting the sliver supply although this roller 4 is still rotating.

When the cause of the absence of a yarn at the outlet of the drawing system has been eliminated by the operator, the latter tilts lever 15 toward the engaged active position of FIG. 2 for which sliver 1 is again introduced in the system. Of course, the detection and/or disengagement means, for example the control device 22 of rods 21, is arranged so as to be active again only after a certain period of time following the restarting of the system, which can be achieved either by a separate control or by a delaytime member.

Of course, the invention is limited neither to the embodiment nor to its mode of application which have been described; on the contrary, one could design various alternatives without departing from its scope; thus, for example, one could modify the mechanical means causing the raising of roller 5 or the means causing the disengagement under the control of the detector means. As other alternatives one could for example suppress spring 30 and create a bilateral connection of lever 15 with armature 12, with or without a dead stroke of the lever with respect to the armature, or control the movements of armature 12 by a member coupling the armature with plate 16, whereby lever 15 is then only usable for the manual resetting in the engaged active position by the user.

I claim:

1. A spinning frame apparatus comprising:

first and second supply rollers, said supply rollers having an engaged position in which said supply rollers are engaged in pressure contact to feed sliver and having a disengaged position in which said supply rollers are relatively displaced to prevent feeding of sliver, one of said supply rollers supported by a member which is spring biased toward a disengaged position of said rollers;

means for overcoming said spring biasing comprising a traction spring, said overcoming means having an active position in which said traction spring generates a force opposing said spring biasing of said member to maintain said engaged position, and having an inactive position in which said traction spring generates a force in cooperation with said spring biasing of said member to maintain said disengaged position;

means for transforming sliver fed from said supply rollers into yarn;

means for detecting the presence of yarn output from said transforming means; and means responsive to said detecting means for relatively displacing said first and second supply rollers, said responsive means comprising: an arm connected to said means for overcoming, and means for controlling said arm to move said overcoming means into said inactive position in response to the failure to detect yarn by said detecting means.

2. The apparatus of claim 1 in which said overcoming means further comprises a lever, said traction spring connected to said lever for moving said lever to either side of a neutral angular position, said traction spring biasing said lever in opposition to said spring biasing of said member when said lever is positioned to a first side of said neutral position and biasing said lever in cooperation with said spring biasing of said member when said lever is positioned to a second side of said neutral position, said traction spring generating sufficient force to overcome the spring biasing of said armature when said lever is positioned to said first side of said neutral position.

3. The apparatus of claim 1 in which said arm has a notch and in which said control means comprises a shaft having a tooth engageable to said notch and means for holding said arm away from said shaft while yarn is detected by said detecting means, said holding means releasing said arm to allow engagement of said notch by said tooth causing said arm to move said overcoming means into said inactive position in response to detection of the absence of yarn by said detecting means.

4. The apparatus of claim 3 in which said holding means comprises a retractable rod.

5. The apparatus of claim 3 in which said control means biases said arm away from said holding means when said overcoming means is in said inactive position.

6. The apparatus of claim 1 in which said detecting means comprises optical means for detecting the presence or absence of yarn.

7. The apparatus of claim 1 in which said detecting means comprises photoelectric means for detecting the presence or absence of yarn.

8. The apparatus of claim 1 in which said detecting means comprises mechanical means for detecting the presence or absence of yarn.

9. A spinning frame apparatus comprising:

first and second supply rollers, said supply rollers having an engaged position in which said supply rollers are engaged in pressure contact to feed sliver and having a disengaged position in which said supply rollers are relatively displaced to prevent feeding of sliver;

means for biasing said rollers into said engaged position or said disengaged position, said biasing means comprising a traction spring, said biasing means movable between an active position in which said traction spring biases said supply rollers into said engaged position, and having an inactive position in which said traction spring biases said supply rollers into said disengaged position;

means for transforming sliver fed from said supply rollers into yarn;

means for detecting the presence of yarn output from said transforming means; and means responsive to said detecting means for relatively displacing said supply rollers, said responsive means comprising: an arm connected to said biasing means, and means for controlling said arm to move said biasing means into said inactive position in response to the failure to detect yarn by said detecting means.

10. The apparatus of claim 9 in which said biasing means further comprises a lever, said traction spring connected to said lever for moving said lever to either side of a neutral angular position, said traction spring biasing said lever to maintain said biasing means in said active position when said lever is positioned to a first side of said neutral position and biasing said lever to maintain said biasing means in said inactive position when said lever is positioned to a second side of said neutral position.

11. The apparatus of claim 9 in which said arm has a notch and in whch said control means comprises a shaft having a tooth engageable to said notch and means for holding said arm away from said shaft while yarn is detected by said detecting means, said holding means releasing said arm to allow engagement of said notch by said tooth causing said arm to move said biasing means into said inactive position in response to detection of the absence of yarn by said detecting means.

* * * * *